US011062386B1

(12) United States Patent
Kotas

(10) Patent No.: US 11,062,386 B1
(45) **Date of Patent: *Jul. 13, 2021**

(54) BID PLACEMENT FOR RANKED ITEMS

(71) Applicant: Amazon Technologies, Inc., Seattle, WA (US)

(72) Inventor: Paul Anthony Kotas, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 104 days.

This patent is subject to a terminal disclaimer.

(21) Appl. No.: 16/427,847

(22) Filed: May 31, 2019

Related U.S. Application Data

(63) Continuation of application No. 14/302,970, filed on Jun. 12, 2014, now Pat. No. 10,354,319.

(51) Int. Cl.
*G06Q 30/08* (2012.01)

(52) U.S. Cl.
CPC ..... *G06Q 30/08* (2013.01)

(58) Field of Classification Search
CPC ..... G06Q 30/08
USPC ..... 705/26.3, 14.71, 14.73
See application file for complete search history.

(56) References Cited

U.S. PATENT DOCUMENTS

2006/0195440 A1* 8/2006 Burges ..... G06F 16/9535
2008/0275757 A1 11/2008 Sharma et al.
2010/0138291 A1 6/2010 Silverman et al.
2010/0250361 A1* 9/2010 Torigoe ..... G06Q 30/0243 705/14.42
2011/0178873 A1 7/2011 Lagudi
2011/0184941 A1* 7/2011 El-Charif ..... G06F 16/248 707/723
2011/0191315 A1* 8/2011 Neumeyer ..... G06Q 30/0243 707/706
2013/0262476 A1* 10/2013 Barak ..... G06F 16/9577 707/748
2013/0304587 A1 11/2013 Ralston
2014/0172565 A1 6/2014 Alon et al.
2015/0332314 A1 11/2015 Chakraborty et al.
2016/0027066 A1* 1/2016 Sachson ..... G06Q 30/0275 705/14.71
2016/0210689 A1* 7/2016 Hummel ..... G06F 16/9577

OTHER PUBLICATIONS

Keiser, Barbie E., From Free to Fee: The next trend in Web site development?, May 2002, Information Today, Inc. vol. 10, Issue 5, p. 1. (Year: 2002).*

* cited by examiner

*Primary Examiner* — Jason B Dunham
*Assistant Examiner* — Brittany E Bargeon
(74) *Attorney, Agent, or Firm* — Thomas | Horstemeyer, LLP

(57) ABSTRACT

Disclosed are various embodiments for a placement bidding application. A list of items is generated. A position of an item within the list is determined according to a bid associated with the item and a display placement preference included with the bid. A number of items from the list are encoded for rendering in a user interface element or on a display of a client device. The number of items is based at least in part on a size limitation of the user interface element or the display of the client device.

20 Claims, 7 Drawing Sheets

100

101

| | |
|---|---|
| 1 | Entry 104a |
| 2 | Entry 104b |
| 3 | Entry 104c |
| 4 | Entry 104d |
| 5 | Entry 104e |
| 6 | Entry 104f |
| 7 | Entry 104g |
| 8 | Entry 104h |
| 9 | Entry 104i |
| 10 | Entry 104j |

107

| | |
|---|---|
| 1 | Entry 104a |
| 2 | Entry 104b |
| 3 | Entry 104f |
| 4 | Entry 104c |
| 5 | Entry 104d |
| 6 | Entry 104e |
| 7 | Entry 104g |
| 8 | Entry 104h |
| 9 | Entry 104i |
| 10 | Entry 104j |

FIG. 1

BID PLACEMENT FOR RANKED ITEMS

CROSS-REFERENCE TO RELATED APPLICATIONS

This application is a continuation of co-pending U.S. utility application entitled, "Bid Placement for Ranked Items," having application Ser. No. 14/302,970, filed Jun. 12, 2014, which is entirely incorporated herein by reference.

BACKGROUND

Ranked lists of items may be generated in order to present highly relevant items to a user. A number of items presented to a user may be limited by a predefined threshold, a display area available for presentation, or other criteria. This may result in only the most relevant items being presented to a user, but also result in reduced visibility for other items.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

FIG. 1 is an example scenario of a placement bidding application interacting with an item selection service according to various embodiments of the present disclosure.

DETAILED DESCRIPTION

Figure 2:
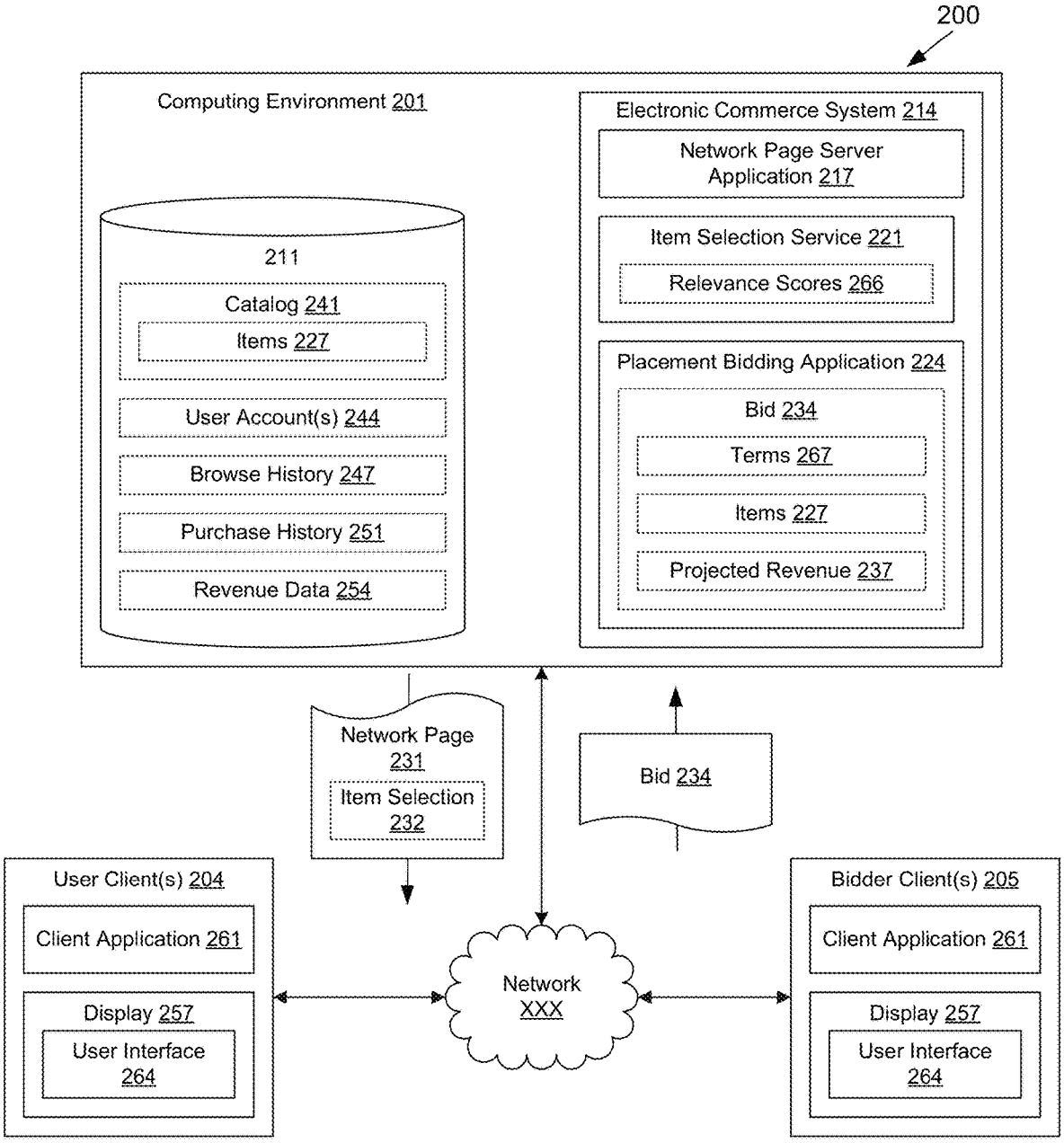
FIG. 2 is a drawing of a networked environment according to various embodiments of the present disclosure.

Ranked lists of items may be generated in order to present the most relevant content to a user. For example, search results responsive to a search query may be ranked according to relevance criteria. The highest ranked search results may then be presented first to a user, as the most relevant results are more likely to be desired by the user. As another example, in an electronic commerce system, selections of items may be ranked according to relevance based on purchase history, page visits in a session, coincident purchases, user account data, or other criteria. The most relevant items are then presented to the user, as a user may be more likely to purchase a more relevant item.

The number of items from a ranked list presented to a user may be limited for a variety of reasons. For example, a search engine may only present a predefined number of search results per page. As another example, a number of items available for inclusion in a display portion of an electronic commerce system network page may be limited by the size of the display portion, or the display size of a client device. By limiting the number of items presented to a user, items that have lower relevance rankings receive reduced user visibility. This may result in reduced sales for items, or other effects.

A placement bidding application allows for merchants, vendors, or other entities associated with ranked items to place bids on the promotion of their items within the ranked list. This allows items that would otherwise not be presented to a user to be included in the subset of items that is presented to the user. A bid may indicate terms such as a price per click, a price per impression, or other terms. The bid may also indicate a desired placement within the ranked list, such as first, centered, above the fold, or another placement. The placement bidding application then calculates projected revenues for the submitted bids based on projected sales revenue, projected revenue according to the bid terms, or other data. The placement bidding application may then accept one or more of the submitted bids according to the projected revenue. The ranking of items corresponding to the accepted bids is then modified to be included in the subset of ranked items communicated to a user. This allows for advantage over promotional mechanisms where an advertisement or other promotion is placed above or otherwise alongside content, as it allows for items to be shifted within the ranking for promotion. In the following discussion, a general description of the system and its components is provided, followed by a discussion of the operation of the same.

With reference to FIG. 1, shown is an example scenario 100 of a ranked list 101 of entries 104*a-j*. Indices 1 through 4 of the ranked list 101 are to be presented to a user. Thus, only entries 104*a-d* would be presented to a user, while entries 104*e-j* would not. Ranked list 107 is a modified version of ranked list 101 according to an accepted bid associated with entry 104*f*. In ranked list 107, entry 104*f* has been increased in rank to index 3. This results in entry 104*c* being shifted down to index 4. Entry 104*d* has been shifted down to index 5, and thus is no longer included in the indices 1 through 4 presented to a user.

Turning now to FIG. 2, shown is a networked environment 200 according to various embodiments. The networked environment 200 includes a computing environment 201, a user client 204, and a bidder client 205, which are in data communication with each other via a network 207. The network 207 includes, for example, the Internet, intranets, extranets, wide area networks (WANs), local area networks (LANs), wired networks, wireless networks, or other suitable networks, etc., or any combination of two or more such networks. For example, such networks may comprise satellite networks, cable networks, Ethernet networks, and other types of networks.

The computing environment 201 may comprise, for example, a server computer or any other system providing computing capability. Alternatively, the computing environment 201 may employ a plurality of computing devices that may be arranged, for example, in one or more server banks or computer banks or other arrangements. Such computing devices may be located in a single installation or may be distributed among many different geographical locations. For example, the computing environment 201 may include a plurality of computing devices that together may comprise a hosted computing resource, a grid computing resource and/or any other distributed computing arrangement. In some cases, the computing environment 201 may correspond to an elastic computing resource where the allotted capacity of processing, network, storage, or other computing-related resources may vary over time.

Various applications and/or other functionality may be executed in the computing environment 201 according to various embodiments. Also, various data is stored in a data store 211 that is accessible to the computing environment 201. The data store 211 may be representative of a plurality of data stores 211 as can be appreciated. The data stored in the data store 211, for example, is associated with the operation of the various applications and/or functional entities described below.

The components executed on the computing environment 201, for example, include an electronic commerce system 214 implementing a network page server application, an item selection service 221, a placement bidding application 224, and other applications, services, processes, systems, engines, or functionality not discussed in detail herein.

The electronic commerce system 214 is executed in order to facilitate the online purchase of items 227 over the network 207. The electronic commerce system 214 also performs various backend functions associated with the online presence of a merchant in order to facilitate the online purchase of items 227 as will be described. For example, the electronic commerce system 214 may implement a network page server application 217 to generate network pages 231 such as web pages or other types of network content that are provided to user clients 204 or bidder clients 205 for the purposes of selecting items for purchase, rental, download, lease, or other form of consumption as will be described. The network page server application 217 may further implement an item selection service 221 to select items 227 for inclusion in an item selection 232 encoded in the network pages 231, as will be described.

The placement bidding application 224 is executed to accept bids 234 from bidder clients 205 associated with items 227 available via the electronic commerce system 214. The placement bidding application 224 is further executed to calculate projected revenues 237 for the submitted bids 234 in order to determine one or more bids 234 for acceptance. The projected revenue 237 for a bid is indicative of revenue that may be generated from the placement of one or more associated items 227 in an item selection 232 should the bid 234 be accepted. The placement bidding application 224 may then communicate with or otherwise access the item selection service 221 to facilitate a modification of a ranking of items 227. The modification results in an item 227 corresponding to an accepted bid 234 being included in an item selection 232 communicated to a user client 204.

The data stored in the data store 211 includes, for example, a catalog 241 of items 227, user accounts 244, a browse history 247, a purchase history 251, revenue data 254, and potentially other data. The catalog 241 may comprise a taxonomy or other organizational structure for encoding items 227. For example, the catalog 241 may comprise categories and subcategories into which an item 227 is classified. In some embodiments, the catalog 241 may be encoded as a taxonomy of nodes, with leaf nodes corresponding to items 227 and interior nodes corresponding to categories or subcategories. The catalog 241 may also classify items according to another approach.

User accounts 244 comprise data associated with one or more customers of the electronic commerce system 214. User accounts 244 may comprise, for example, login information such as usernames or passwords to authenticate a customer attempting to access the electronic commerce system 214. The user accounts 244 may also comprise contact information such as a mailing address, email address, phone number or other contact information. Additionally, the user accounts 244 may comprise data representing payment instruments used to consummate an order with the electronic commerce system 214, including credit cards, debit cards, banking accounts, prepaid accounts, or other payment instruments. User accounts 244 may also comprise user preferences embodying settings, configurations, or other preferences used in interactions with the electronic commerce system 214 as will be described below.

Browse history 247 may indicate a history of interactions by user clients 204 with respect to the electronic commerce system 214 and/or other network sites. For example, a browse history 247 may indicate item 227 detail pages or other network pages 227 requested by a user client 204. Browse history 247 may also indicate submitted search queries or other interactions with an electronic commerce system 214. To this end, browse history 247 may be defined with respect to user accounts 244, or aggregated across multiple users of the electronic commerce system 214. Additionally, a browse history 247 may indicate network site interactions distinct from the electronic commerce system 214. For example, a browse history 247 may include network sites visited by a user client 204 as determined by a cookie or other tracking data accessible by the electronic commerce system 214. The browse history 247 may also include other data.

Purchase history 251 may indicate a purchase, lease, rental, or other action taken with respect to an item 227 available via the electronic commerce system 214. Purchase history 251 may also indicate actions taken with respect to an item 227 after an order has been consummated. For example, purchase history 251 may indicate subsequent cancellation of orders, returns of items 227 for refunds or exchanges, trade-ins of items 227, or other actions. Purchase history 251 may also include other data. To this end, purchase history 251 may be defined with respect to user accounts 244, or aggregated across multiple users of the electronic commerce system 214.

Revenue data 254 may indicate projected or known revenue associated with items 227. For example, revenue data 254 may indicate a profit margin associated with the sale of an item 227. This may be calculated according to a sale price for an item 227, a price to purchase an item 227 from a manufacturer or distributor, warehousing, storage or other maintenance costs, distribution or shipping costs, or other data. Revenue data 254 may also indicate a net revenue for distribution of digital items 227 according to licensing terms or other agreements, bandwidth, storage, or other distribution overhead, or other data.

The user client 204 and bidder client 205 are representative of a plurality of client devices that may be coupled to the network 207. The user client 204 and bidder client 205 may each comprise, for example, a processor-based system such as a computer system. Such a computer system may be embodied in the form of a desktop computer, a laptop computer, personal digital assistants, cellular telephones, smartphones, set-top boxes, music players, web pads, tablet computer systems, game consoles, electronic book readers, or other devices with like capability. The user client 204 and bidder client 205 may respectively include a display 257. The display 257 may comprise, for example, one or more devices such as liquid crystal display (LCD) displays, gas plasma-based flat panel displays, organic light emitting diode (OLED) displays, electrophoretic ink (E ink) displays, LCD projectors, or other types of display devices, etc.

The user client 204 and bidder client 205 may be configured to execute various applications such as a client application 261 and/or other applications. The client application 261 may be executed in a user client 204 or bidder client 205, for example, to access network content served up by the computing environment 201 and/or other servers, thereby rendering a user interface 264 on the display 257. To this end, the client application 261 may comprise, for example, a browser, a dedicated application, etc., and the user interface 264 may comprise a network page, an application screen, etc. The user client 204 or bidder client 205 may be configured to execute applications beyond the client application 261 such as, for example, email applications, social networking applications, word processors, spreadsheets, and/or other applications.

Next, a general description of the operation of the various components of the networked environment 200 is provided. To begin, the item selection service 221 calculates relevance scores 266 for items 227 that may potentially be included in an item selection 232 to be communicated to a user client 204. In some embodiments, this may be performed in response to a request from a user client 204 for a network page 231 into which the item selection 232 will be included. In other embodiment, this may be performed as a background process by the item selection service 221 to allow the item selection 232 to be precomputed for later communication to a user client 204.

The items 227 for which relevance scores 266 are calculated may be determined according to the item selection 232. For example, if the item selection 232 is for search results, relevance scores 266 may be calculated for those items 227 that are responsive to the search query according to various search approaches as can be appreciated. As another example, if the item selection 232 is for items 227 included in a defined category or taxonomy node according to the catalog 241, relevance scores 266 may be calculated for those included items 227.

The item selection service 221 may calculate relevance scores 266 according to a browse history 247. For example, items 227 more frequently viewed may result in a higher relevance score 266. As another example, items 227 sharing similar attributes to those viewed by a particular user or by a population of users may have a higher relevance score 266. Relevance scores 266 may further be calculated according a selection of items 227 viewed within a session or clickstream as set forth in a browse history 247. Similarly, relevance scores 266 may be calculated according to a purchase history 251, where more frequently purchased items 227 or items 227 more frequently purchased together may be deemed more relevant. Items 227 sharing similar attributes to those purchased by a particular user or by a population of users may have a higher relevance score 266. Relevance scores 266 may also be calculated according to a selection of items 227 as included in wish lists, shopping carts, or other groupings of items 227 generated by users. Relevance scores 266 may also be calculated by other approaches as can be appreciated. After calculating the relevance scores 266, the item selection service 221 ranks the items 227 according to the relevance scores 266.

Next, the placement bidding application 224 obtains bids 234 from bidder clients 205. It is understood that, in this example, the bids 234 are shown as being after a ranking of items 227, it is understood that in some embodiments the bids 234 may be obtained before a ranking of items 227 is generated, for example, to ensure the inclusion of an associated item 227 in the item selection 232. The obtained bids 234 are bids 234 to obtain placement within an item selection 232 generated by the item selection service 221. For example, bids 234 may be obtained to increase the visibility of an item 227 by including the item 227 in an item selection 232. As another example, bids 234 may be obtained to insert an advertisement or other data as an entry into an item selection 232. Bids 234 may also be obtained for another purpose.

Bidder clients 205 may correspond to manufacturers, vendors, marketers, or other entities associated with items 227 sold, advertised, or otherwise promoted via the electronic commerce system 214. A bid 234 may include terms 267 indicating what performance is required by the electronic commerce system 214 and the corresponding bidder should the bid 234 be accepted. For example, terms 267 may indicate a cost per click or cost per impression the bidder agrees to pay. The cost per click or cost per impression would indicate, for example, a price paid by the bidder for each click or impression on an item selection 232 entry corresponding to the bid 234. The terms 267 may also indicate a duration or other termination conditions for the inclusion of the item selection 232 entry corresponding to the bid 234. The terms 267 may further indicate a desired placement of an item selection 232 entry. For example, terms 267 may indicate that an item 227 or an advertisement corresponding to the bid 234 should be placed at a median of the item selection 232, be placed first or last in the item selection 232, or indicate another placement.

Bids 234 may also indicate one or more items 227 to which the terms 267 apply. For example, bids 234 may indicate a single item 227 or predefined list of items 227 for promotion to the item selection 232. In some embodiments, bids 234 may indicate a grouping or classification of items 227 to which the terms 267 apply. For example, a bid 234 may apply to all items 227 produced by a manufacturer. As another example, bids 234 may indicate criteria allowing for dynamic determination of to which items 227 the terms 267 apply. For example, a bid 234 may indicate that the terms 267 apply to items 227 released within a defined time period, a collection of items 227 defined by sales or visibility data, or other criteria. Bids 234 may also indicate an advertisement, promotion, coupon, or other message to be placed within a ranked item selection 232 upon acceptance of the bid 234. Bids 234 may also indicate an item selection 232 to which the bid 234 applies. For example, a bid 234 may indicate that items 227 indicated in the bid 234 to be promoted within an item selection 232 for user recommended items 227, for popular items 227 within a predefined classification or category, or other items selections 232. Bids 234 may also indicate that they are to be applied to any item selection 232 into which the identified items 227 may be included. Bids 234 may also comprise other data.

The placement bidding application 224 may obtain bids 234 until a defined termination criterion is satisfied. For example, bids 234 may be obtained until expiration of a defined time duration, until a number of bids 234 have been obtained, or by another approach. Using the previously obtained bids 234, the placement bidding application 224 calculates projected revenues 237 for each of the bids 234. In some embodiments, the projected revenues 237 for a bid 234 may be based on purchase history 251 for an item 227 indicated by the bid 234, or items 227 sharing similar attributes to an item 227 indicated by the bid. This may include, for example, calculating future sales based on a trend of previous sales indicated by the purchase history 251. A rate or number of future sales may be factored by revenue data 254 for the corresponding item 227 to determine a portion of the projected revenue 237.

The projected revenue 237 may also be based on the terms 267 of the bid 234. For example, a bid 234 may indicate a cost per click or cost per impression. The placement bidding application 224 may calculate a predicted click rate or predicted impression rate for an item 227 indicated by a bid 234. This may be based on a browse history 247 associated with the item 227 indicated by the bid 234 or other items 227 having similar attributes. The cost per click or cost per impression may then be factored by the predicted click rate or served impression rate to calculate a portion of the projected revenue 237. Additionally, the projected revenue 237 may be based on a requested placement of an indicated item 227 in the item selection 232. For example, for an item selection 232 rendered in a left to right orientation, a leftmost item 227 may have a higher click rate than other items 227. The projected revenue 237 may also be based on the terms 267 of the bid 234 by other approaches.

The projected revenue 237 may also be based on a conversion rate for an item 227 indicated by the bid 234. The conversion rate may be known or projected as a historical conversion rate of a respective item 227 detail page according to browse history 247, purchase history 251, or other data. A predicted or known click rate for an item 227 may be factored by a conversion rate and revenue data 254 to determine a portion of the projected revenue 237.

The projected revenue 237 may also be affected by relevance scores 266 for items 227 indicated by the bid 234. For example, a projected click rate, conversion rate, sale rate, or other factors of a projected revenue 237 may be weighted or modified according to a relevance score 266. This may be performed according the relevance score 266 of the item 227 indicated by the bid 234. This may also be performed according to a difference between the relevance score 266 of the item 227 indicated by the bid 234 and one or more relevance scores 266 for other items 227 ranked by the item selection service 221 that may be included in the item selection 232. The projected revenues 237 may also be calculated by other approaches.

Next, the placement bidding application 224 determines whether to accept one or more of the bids 234. In some embodiments, this may comprise accepting one or more of the bids 234 having a highest calculated projected revenue 237. In other embodiments, the placement bidding application 224 may be configured to calculate projected revenues 237 for items 227 ranked by the item selection service 221 for potential inclusion in the item selection 232. This may be performed by similar approaches as were discussed above with respect to items 227 indicated in bids 234. In such an embodiment, the placement bidding application 224 may accept a bid 234 if the corresponding projected revenue 237 is greater than a projected revenue 237 for an item 227 that would otherwise be included in the item selection 232 communicated to the user client 204. In other embodiments, the placement bidding application 224 may accept a bid 234 based on lost revenue associated with removing an item 227 from the item selection 232.

For example, an item selection 232 may be determined to include the five highest ranked items 227 ranked according to relevance scores 266 calculated by the item selection service 221. The placement bidding application 224 may be configured to calculate projected revenues 237 for the five items 227 having the greatest relevance scores 266 and projected revenues 237 for the submitted bids 234. The placement bidding application 224 may then accept one or more of the bids whose projected revenues 237 are greater than the projected revenues 237 for one or more of the five highest ranked items 227.

Additionally, in some embodiments, the placement bidding application 224 may enforce a limit on a degree to which an item 227 may be shifted within a ranking of items 227. For example, the placement bidding application 224 may be configured to restrict an item 227 being promoted via bidding to an increase of no more than five degrees of rank. In this example, an item selection 232 may include the five items 227 having highest relevance scores 266. The placement bidding application 224 may be configured to automatically reject or ignore a bid 234 which would move an eleventh ranked item 227 to the fifth rank for inclusion in the item selection 232. However, the placement bidding application 224 may accept a bid 234 which would move a seventh ranked item 227 to the fifth rank for inclusion in the item selection 232.

The placement bidding application 224 may also be configured to not accept any bids 234 under certain circumstances. For example, if the projected revenues 237 for each of the bids is less than the projected revenues 237 for items 227 in the item selection 232, it may be more profitable to not accept any bids 234 and preserve the state of the item selection 232. The placement bidding application 224 may accept bids 234 by another approach.

Next, the item selection service 221 modifies the previously generated ranking of items 227 according to the accepted bid 234. In some embodiments, this may include shifting an item 227 indicated by the bid 234 by a number of degrees such that the shifted item 227 has a high enough rank to be included in the item selection 232. In other embodiments, this may include inserting an advertisement or other element into the ranking for inclusion in the item selection 232. The item selection service 221 may also modify the ranking of the items 227 by another approach.

After modifying the ranking of the items 227, the item selection service 221 selects a number of the ranked items 227 for inclusion in the item selection 232. In some embodiments, the number of ranked items 227 included in the item selection 232 is predefined. In other embodiments, the number of ranked items 227 in the item selection 232 is calculated according to a display 257 size or resolution for the user client 204. In other embodiments, the number of ranked items 227 in the item selection 232 is calculated according to a user interface 264 element size. User interface 264 element sizes may include a window size, a frame size, a network page 231 component size, or other element size. In some embodiments, this may result in an item selection 232 of a dynamically determined size as a window or frame is resized. The item selection 232 may then require updating or refreshing via Asynchronous JavaScript (AJAX) calls, or another approach. Items 227 may also be selected for inclusion in the item selection 232 by another approach.

The network page server application 217 then communicates a network page 231 encoding the item selection 232 to the user client 204. In embodiments in which an item selection 232 size may change dynamically, this may also include sending an update or addition to a item selection 232 previously communicated item selection 232. In some embodiments, this includes encoding images, links, or other navigation elements corresponding to the items 227 in the item selection 232. This may further include encoding a graphical indicator or other identifier for items 227 promoted via the placement bidding application 224. For example, an image or icon corresponding to a promoted item 227 may include text indicating the item as "sponsored," a distinguishing icon or highlighting, or other identifier.

Figure 3:
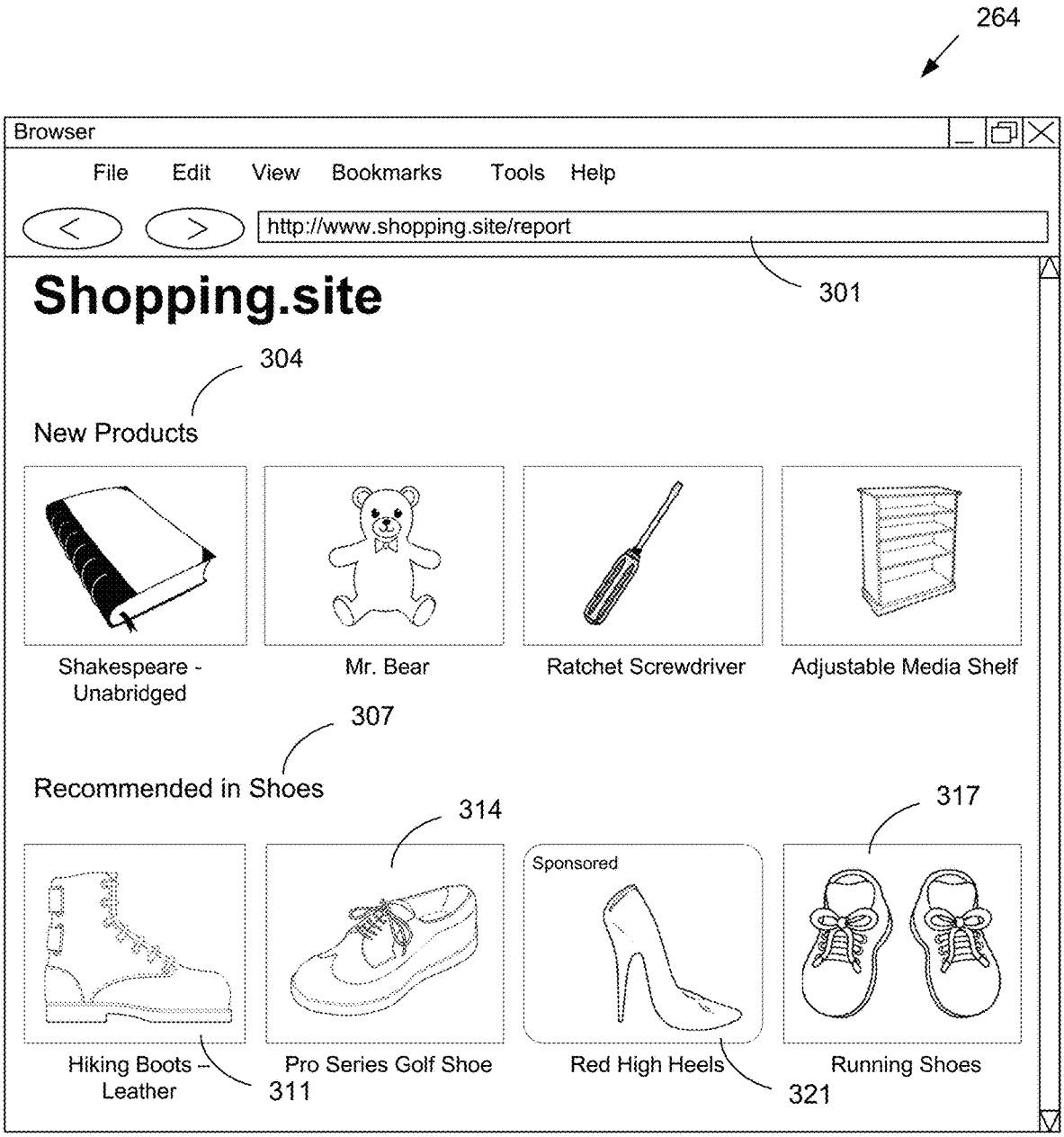
FIGS. 3 and 4 are pictorial diagrams of an example user interface rendered by a client in the networked environment of FIG. 2 according to various embodiments of the present disclosure.

Turning now to FIG. 3, shown is an example user interface 264 rendered on a display 257 (FIG. 2) of a user client 204 (FIG. 2) rendering a network page 231 (FIG. 2) served by the network page server application 217 (FIG. 1) of the electronic commerce system 214 (FIG. 2). Element 301 is a Uniform Resource Locator (URL) directed to the electronic commerce system 214. Element 304 is a representation of a first item selection 232 (FIG. 2) encoded in the network page 231 for a selection of newly released items 227 (FIG. 2). Element 307 is a representation of a second item selection 232. Included in the second item selection 232 are items 227 represented by elements 311, 314, 317 and 321.

Elements 311, 314 and 317 correspond to items 227 having relevance scores 266 (FIG. 2) above a threshold for inclusion in the second item selection 232. Element 321 corresponds to an item 227 having been promoted in rank according to a bid 234 (FIG. 2) submitted to the placement bidding application 224. Having been promoted in rank, the item 227 corresponding to element 321 meets or exceeds the threshold for inclusion in the second item selection 232. Element 321 is optionally rendered with a border distinct from elements 311, 314 and 317 to indicate the corresponding item 227 as having been sponsored. Element 321 further includes a text notification that the corresponding item 227 has been sponsored for inclusion in the second item selection 232.

Figure 4:
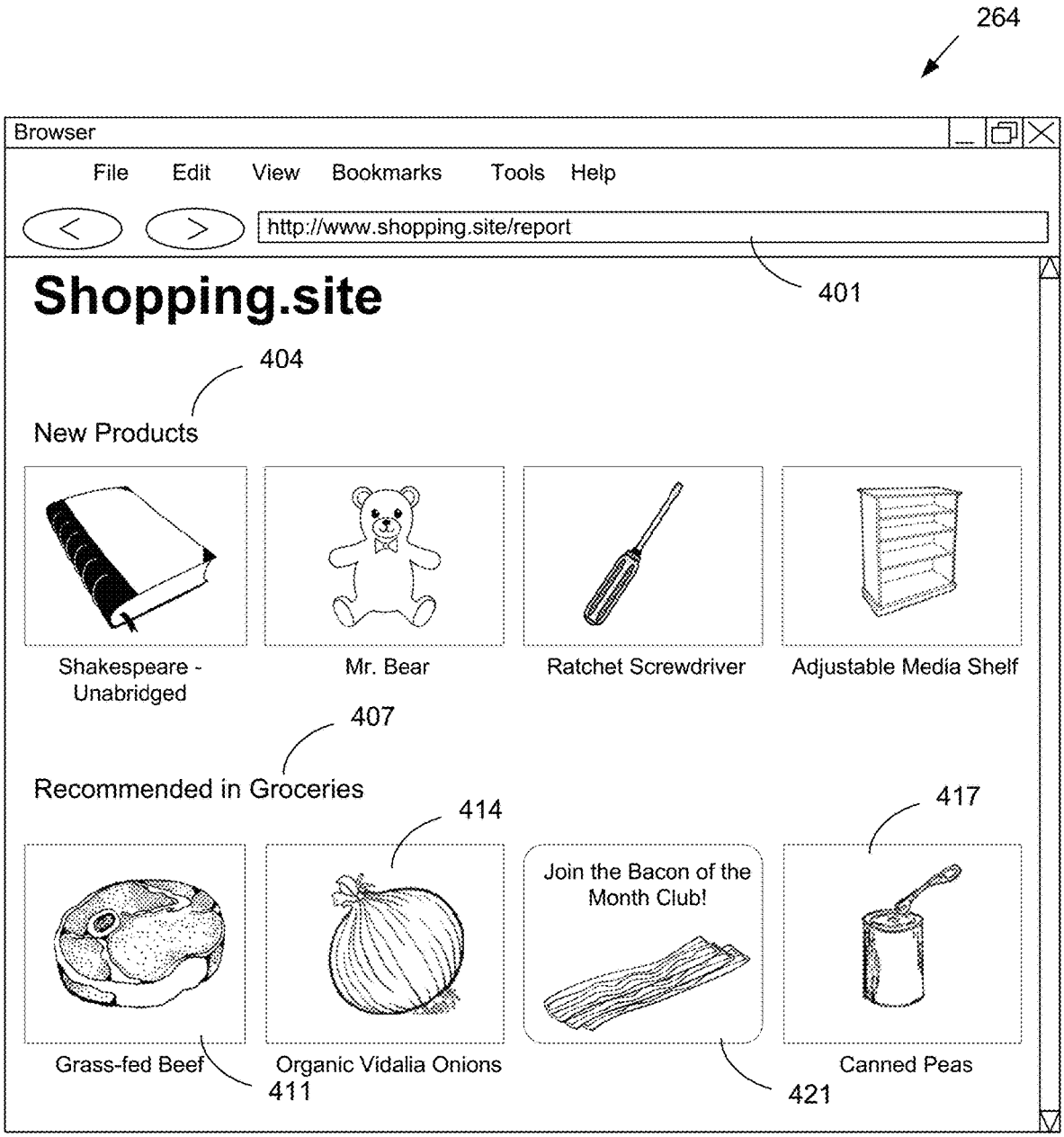

Moving on to FIG. 4, shown is an example user interface 264 rendered on a display 257 (FIG. 2) of a user client 204 (FIG. 2) rendering a network page 231 (FIG. 2) served by the network page server application 217 (FIG. 2) of the electronic commerce system 214 (FIG. 2). Element 401 is a Uniform Resource Locator (URL) directed to the electronic commerce system 214. Element 404 is a representation of a first item selection 232 (FIG. 2) encoded in the network page 231 for a selection of newly released items 227 (FIG. 2). Element 407 is a representation of a second item selection 232. Included in the second item selection 232 are items 227 represented by elements 411, 414, 417 and 421.

Elements 411, 414 and 417 correspond to items 227 having relevance scores 266 (FIG. 2) above a threshold for inclusion in the second item selection 232. Element 421 corresponds to an advertisement inserted into the second item selection 232 according to a bid 234 (FIG. 2) submitted to the placement bidding application 224. Element 421 is optionally rendered with a border distinct from elements 311, 314 and 317 to indicate element 421 as an advertisement.

Figure 5:
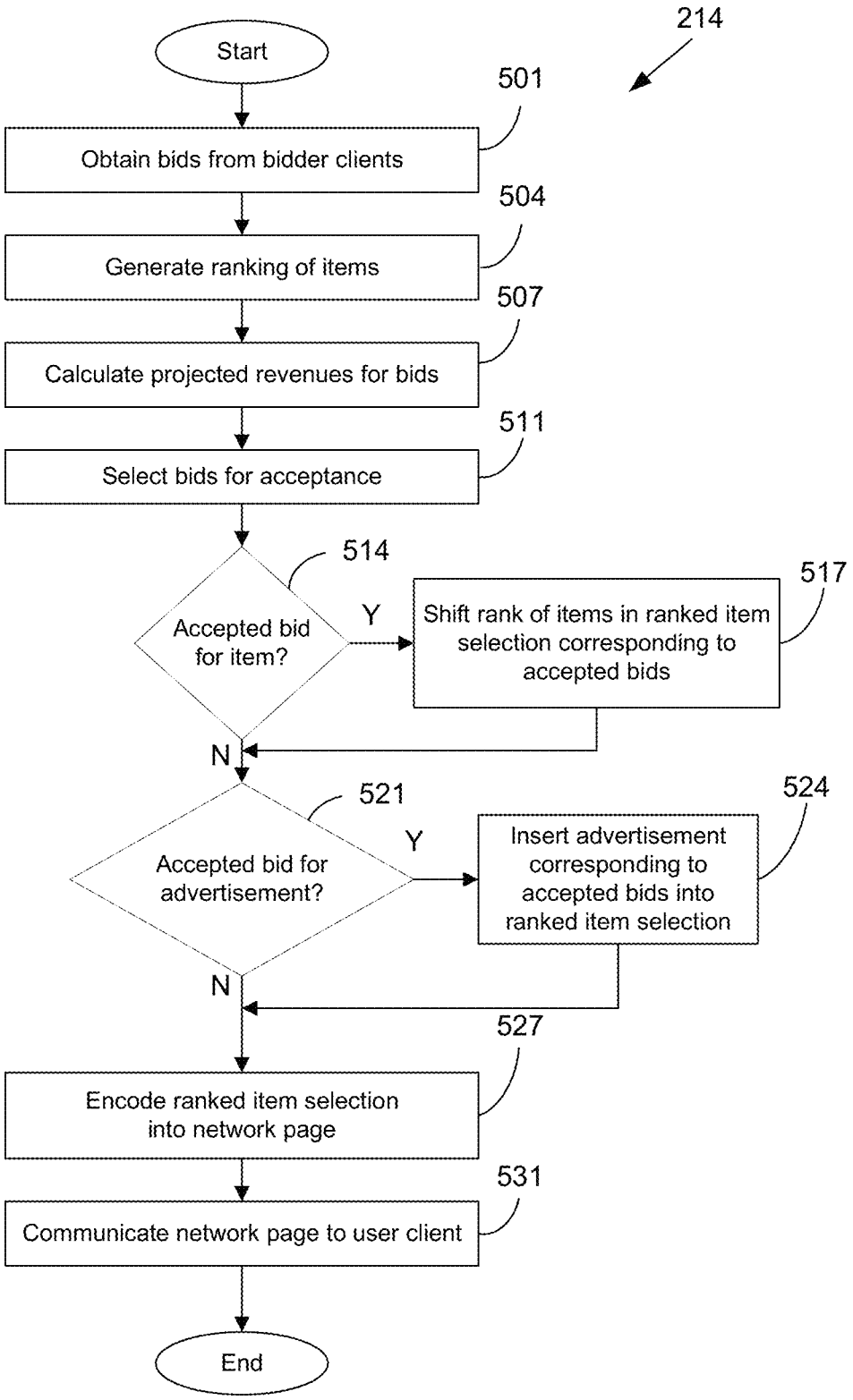
FIGS. 5 and 6 are flowcharts illustrating examples of functionality implemented as portions of a placement bidding application executed in a computing environment in the networked environment of FIG. 2 according to various embodiments of the present disclosure.

Referring next to FIG. 5, shown is a flowchart that provides one example of the operation of a portion of the electronic commerce system 214 implementing a placement bidding application 224 (FIG. 2) according to various embodiments. It is understood that the flowchart of FIG. 5 provides merely an example of the many different types of functional arrangements that may be employed to implement the operation of the portion of the electronic commerce system 214 as described herein. As an alternative, the flowchart of FIG. 5 may be viewed as depicting an example of elements of a method implemented in the computing environment 201 (FIG. 2) according to one or more embodiments.

Beginning with box 501, the placement bidding application 224 obtains bids 234 (FIG. 2) from bidder clients 205 (FIG. 2). In some embodiments, this may comprise exposing an application program interface (API) accessible to the bidder clients 205 for submission of bids 234 via the network 207 (FIG. 2). In other embodiments, this may comprise obtaining bids 234 via a network page 231 (FIG. 2) encoding a user interface 264 (FIG. 2) rendered on a display 257 (FIG. 2) of a bidder client 205 to facilitate the generation and communication of a bid 234. Bids 234 may also be obtained by another approach.

Next, in box 504, the item selection service 221 (FIG. 2) generates a ranking of items 227 (FIG. 2) for possible inclusion in an item selection 232 (FIG. 2) communicated to a user client 204. This may include, for example, selecting items 227 from a catalog 241 (FIG. 2) according to defined criteria for inclusion in the item selection 232. For example, the item selection 232 may include a selection of shoes. The item selection service 221 may select all or a portion of shoe items 227 from the catalog 241. As another example, the item selection 232 may include recently released items 227. The item selection service 221 may select all or a portion of items 227 having a release date meeting or exceeding a threshold. Items 227 may also be selected by another approach.

The item selection service 221 then calculates relevance scores 266 (FIG. 1) for the selected items 227 and ranks the items 227 according to the relevance scores 266. The item selection service 221 may calculate relevance scores 266 according to a browse history 247 (FIG. 2). For example, items 227 more frequently viewed may result in higher relevance scores 266. As another example, items 227 sharing similar attributes to those viewed by a particular user or by a population of users may have higher relevance scores 266. Similarly, relevance scores 266 may be calculated according to a purchase history 251 (FIG. 1), where more frequently purchased items 227 may be deemed more relevant. Items 227 sharing similar attributes to those purchased by a particular user or by a population of users may have higher relevance scores 266. Relevance scores 266 may also be calculated by other approaches as can be appreciated.

After the ranking of items 227 has been generated, in box 507, the placement bidding application 224 calculates projected revenues 237 (FIG. 2) for the obtained bids 234 (FIG. 2). The projected revenues 237 for bids 234 may be calculated according to projected sales for items 227 corresponding to a bid 234. The projected revenues 237 may also be calculated according to the terms 267 (FIG. 1) of a bid 234 and projected user interactions with respect to a promoted item 227 or advertisement. Projected revenues 237 may also be calculated by other approaches as will be described in detail below.

Next, in box 511, the placement bidding application 224 selects bids 234 for acceptance. In some embodiments, the placement bidding application 224 accepts one or more of the bids 234 having a highest projected revenue 237. The highest projected revenue 237 may be determined with respect to others of the bids 237. Additionally, determining a highest projected revenue 237 may be performed with or without consideration of projected revenues 237 for items 227 that do not correspond to bids 234 or otherwise unsponsored items 227. In other embodiments, the placement bidding application 224 accepts one or more of the bids 234 having a higher projected revenue 237 than the projected revenue 237 of an item 227 having a rank meeting or exceeding a threshold for inclusion in the item selection 232.

The placement bidding application 224 may also limit or restrict those bids 234 which may be accepted. For example, the placement bidding application 224 may only accept those bids 234 corresponding to items 227 meeting a minimum relevance score 266 threshold. As another example, the placement bidding application 224 may only accept those bids 234 whose acceptance would increase the rank of a corresponding item 227 meeting or falling below a maximum threshold. The placement bidding application 224 may also limit or restrict bids 234 by another approach.

Additionally, the placement bidding application 224 may weight or otherwise preferentially accept bids 234 according to a tier or classification of a merchant, vendor, or other entity associated with the bid 234. For example, an electronic commerce system 214 may assign merchants or vendors into tiers for promotional purposes, preferential distribution, price, or other benefits. Bids 234 from a merchant or vendor of a higher tier may receive a higher weight compared to other bids 234. As another example, bids 234 from a merchant or vendor of a higher tier may be automatically accepted over bids 234 from a lower tiered entity, even if the accepted bid 234 is associated with a lower projected revenue 237 or other evaluation criteria. Bids 234 may also be accepted according to a tier or classification of an entity by another approach.

In box 514, if the placement bidding application 224 has accepted a bid for an item 227 to be included in the item selection 232, the process advances to box 517. Otherwise, the process advances to box 521. In box 517, the rank of items 227 in the ranking of items 227 generated in box 504 is shifted such that the items 227 corresponding to the accepted bid 234 meet or exceed a minimum rank threshold for inclusion in the item selection 232. This may include shifting an item 227 corresponding to an accepted bid 234 a defined number of degrees or positions within the ranking. This may also include shifting an item 227 corresponding to an accepted bid 234 to a defined placement or rank within the ranking. Shifting the items 227 in the ranking of items 227 may also be performed by another approach. The process then advances to box 521.

In box 521, the placement bidding application 224 determines if a bid 234 for an advertisement has been accepted. If a bid has been accepted, the process advances to box 524 where the advertisement is inserted into the ranking of items 227 generated in box 504. The rank at which the advertisement is inserted may be determined according to terms 267 of the bid 234, or by another approach. The process then advances to box 527 where the network page server application 217 (FIG. 1) encodes a network page 231 (FIG. 1) including an item selection 232. The item selection 232 includes a highest ranked subset of items 227 from the ranking of items 227. For example, the item selection 232 may include a subset of items 227 from the ranking of items 227, including promoted items 227 or advertisements corresponding to accepted bids 234, having a rank meeting or exceeding a predefined threshold. Generating the network page 231 may include encoding identifiers for promoted items 227 or advertisements to distinguish them from other of the items 227. Such identifiers may include a distinct color, border, or transparency, a text indicator, or other identifiers.

Next, the process advances to box 531 where the network page 231 is communicated via the network 207 to a user client 204, after which the process ends.

Figure 6:
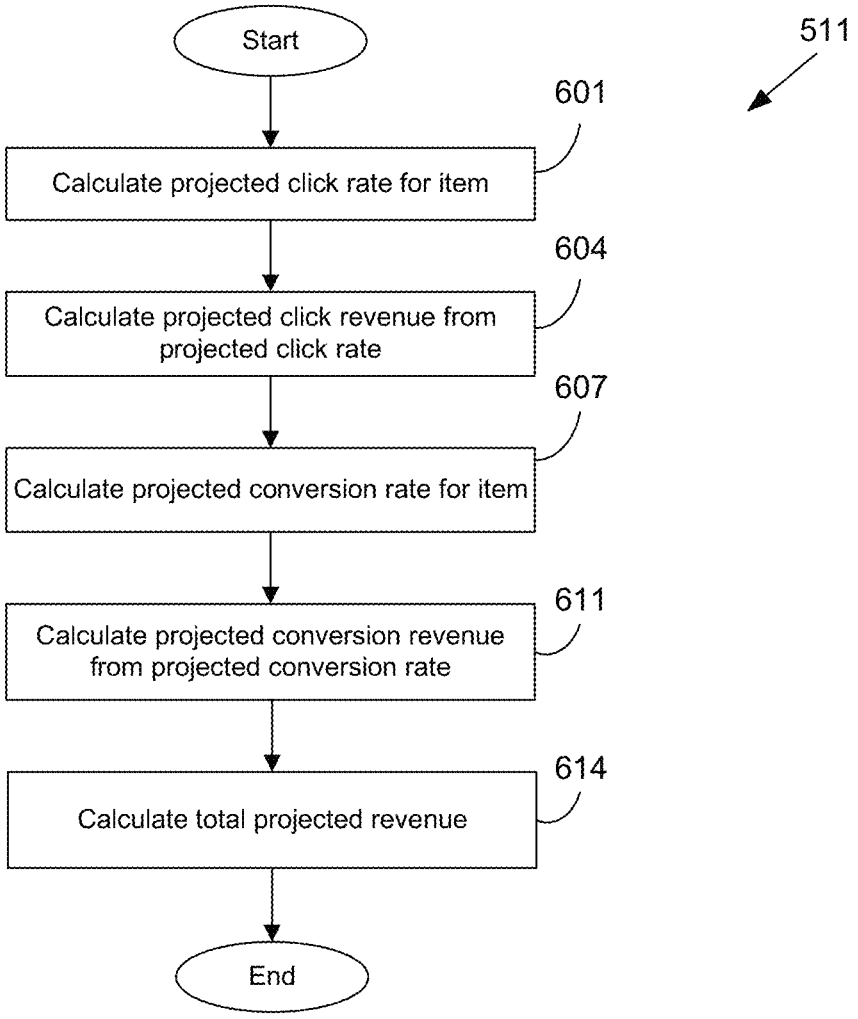

Referring next to FIG. 6, shown is a flowchart that provides one example of the operation of a portion of the placement bidding application 224 (FIG. 2) for calculating projected revenues 237 (FIG. 2) as described in box 511 (FIG. 5) according to various embodiments. It is understood that the flowchart of FIG. 6 provides merely an example of the many different types of functional arrangements that may be employed to implement the operation of the portion of the placement bidding application 224 as described herein. As an alternative, the flowchart of FIG. 6 may be viewed as depicting an example of elements of a method implemented in the computing environment 201 (FIG. 2) according to one or more embodiments.

Beginning with box 601, the placement bidding application 224 calculates a projected click rate for an item 227 (FIG. 2). This may include, for example, accessing a browse history 247 (FIG. 2) to determine a degree to which an indication of an item 227 has been clicked with respect to a number of impressions for the item 227. This may also include calculating a time series or other projection for a click rate and calculating the projected click rate according to the time series. The projected click rate may also be calculated according to a relevance score 266 (FIG. 2) of an item 227. For example, the projected click rate of an item 227 may be modified according to a deviation between the relevance score 266 of the item 227 and the relevance scores 266 of highly ranked items 227 that may be included in an item selection 232 (FIG. 2). The projected click rate may also be calculated by another approach.

Next, in box 604, the placement bidding application 224 calculates a portion of the projected revenue 237 according to the projected click rate. This may include factoring the projected click rate by a cost per click indicated in terms 267 (FIG. 2) of a bid 234. The projected revenue 237 may be calculated over time according to a time series of projected click rates and a duration indicated in the terms 267 of the bid 234, or by another approach.

The placement bidding application 224 then calculates a projected conversion rate for an item 227 in box 607. This may include accessing a browse history 247 to determine a number of views of an item 227 detail page and accessing a purchase history 251 to determine a number of sales for an item 227 indicated in a bid 234, or items 227 having similar attributes. The projected conversion rate may then be calculated as a function of a ratio of views of an item 227 to a number of sales of an item 227. The projected conversion rate may be calculated by generating a time series of samplings of item 227 detail page views and item 227 sales. The projected conversion rate may also be calculated by another approach.

After calculating the projected conversion rate, in box 611, a portion of the projected revenue 237 may be calculated according to the projected conversion rate. This may include, for example, factoring the projected conversion rate and projected click rate by revenue or costs associated with the item 227 indicated in revenue data 254 (FIG. 2). Such revenue may include profit margins, maintenance costs, licensing fees, collected merchant fees, or other data.

The placement bidding application 224 then calculates a total projected revenue 237 for an item 227 indicated in a bid 234 in box 614. This may include calculating a total of the portions of projected revenue 237 calculated in boxes 604 and 611. This may include modifying the total projected revenue 237 according to additional portions of projected revenue 237, or other data. The process then ends.

Figure 7:
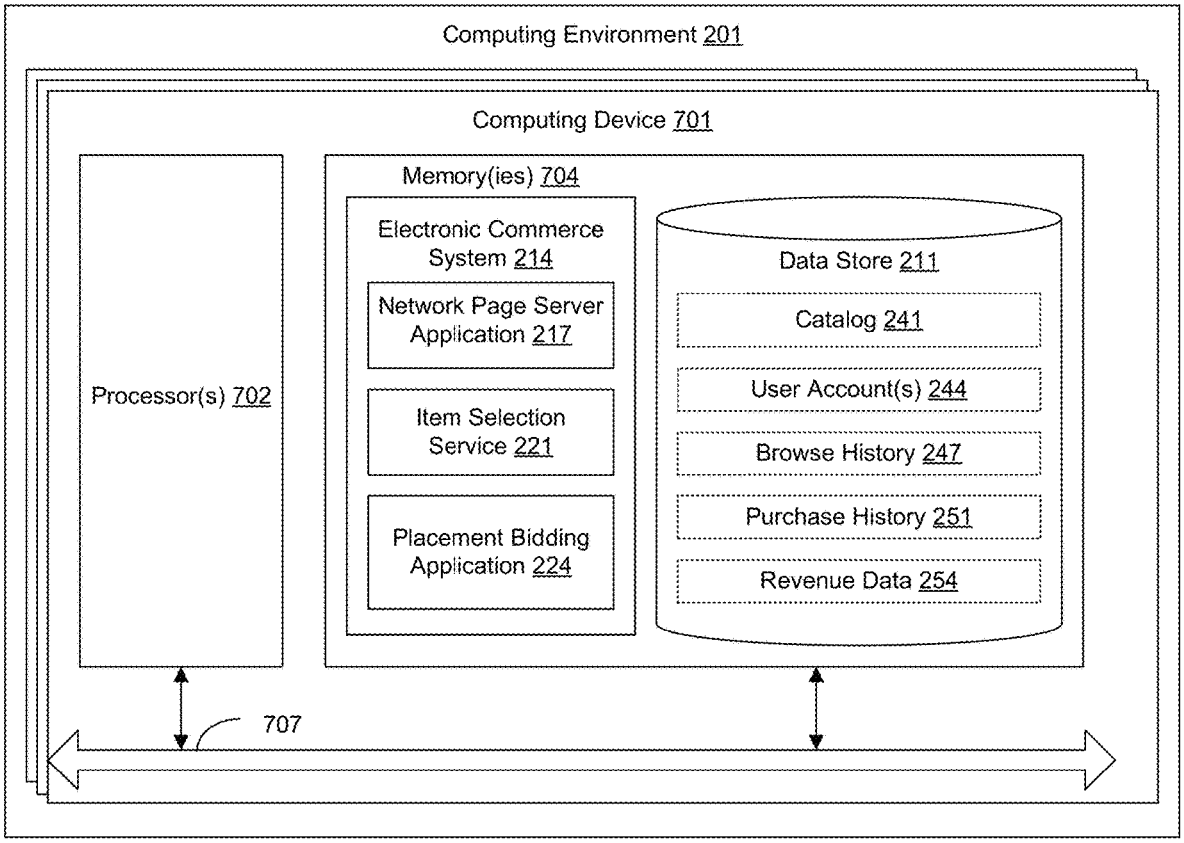
FIG. 7 is a schematic block diagram that provides one example illustration of a computing environment employed in the networked environment of FIG. 2 according to various embodiments of the present disclosure.

With reference to FIG. 7, shown is a schematic block diagram of the computing environment 201 according to an embodiment of the present disclosure. The computing environment 201 includes one or more computing devices 701. Each computing device 701 includes at least one processor circuit, for example, having a processor 702 and a memory 704, both of which are coupled to a local interface 707. To this end, each computing device 701 may comprise, for example, at least one server computer or like device. The local interface 707 may comprise, for example, a data bus with an accompanying address/control bus or other bus structure as can be appreciated.

Stored in the memory 704 are both data and several components that are executable by the processor 702. In particular, stored in the memory 704 and executable by the processor 702 are an electronic commerce system 214 implementing a network page server application 217, an item selection service 221 and a placement bidding application 224, and potentially other applications. Also stored in the memory 704 may be a data store 211 storing a catalog 241, user accounts 244, browse history 247, purchase history 251, revenue data 254 and other data. In addition, an operating system may be stored in the memory 704 and executable by the processor 702.

It is understood that there may be other applications that are stored in the memory 704 and are executable by the processor 702 as can be appreciated. Where any component discussed herein is implemented in the form of software, any one of a number of programming languages may be employed such as, for example, C, C++, C#, Objective C, Java®, JavaScript®, Perl, PHP, Visual Basic®, Python®, Ruby, Flash®, or other programming languages.

A number of software components are stored in the memory 704 and are executable by the processor 702. In this respect, the term "executable" means a program file that is in a form that can ultimately be run by the processor 702. Examples of executable programs may be, for example, a compiled program that can be translated into machine code in a format that can be loaded into a random access portion of the memory 704 and run by the processor 702, source code that may be expressed in proper format such as object code that is capable of being loaded into a random access portion of the memory 704 and executed by the processor 702, or source code that may be interpreted by another executable program to generate instructions in a random access portion of the memory 704 to be executed by the processor 702, etc. An executable program may be stored in any portion or component of the memory 704 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 704 is defined herein as including both volatile and nonvolatile memory and data storage components. Volatile components are those that do not retain data values upon loss of power. Nonvolatile components are those that retain data upon a loss of power. Thus, the memory 704 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 702 may represent multiple processors 702 and/or multiple processor cores and the memory 704 may represent multiple memories 704 that operate in parallel processing circuits, respectively. In such a case, the local interface 707 may be an appropriate network that facilitates communication between any two of the multiple processors 702, between any processor 702 and any of the memories 704, or between any two of the memories 704, etc. The local interface 707 may comprise additional systems designed to coordinate this communication, including, for example, performing load balancing. The processor 702 may be of electrical or of some other available construction.

Although the placement bidding application 224, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits (ASICs) having appropriate logic gates, field-programmable gate arrays (FPGAs), or other components, etc. Such technologies are generally well known by those skilled in the art and, consequently, are not described in detail herein.

The flowcharts of FIGS. 5 and 6 show the functionality and operation of an implementation of portions of the placement bidding application 224. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 702 in a computer system or other system. The machine code may be converted from the source code, etc. If embodied in hardware, each block may represent a circuit or a number of interconnected circuits to implement the specified logical function(s).

Although the flowcharts of FIGS. 5 and 6 show a specific order of execution, it is understood that the order of execution may differ from that which is depicted. For example, the order of execution of two or more blocks may be scrambled relative to the order shown. Also, two or more blocks shown in succession in FIGS. 5 and 6 may be executed concurrently or with partial concurrence. Further, in some embodiments, one or more of the blocks shown in FIGS. 5 and 6 may be skipped or omitted. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the placement bidding application 224, that comprises software or code can be embodied in any non-transitory computer-readable medium for use by or in connection with an instruction execution system such as, for example, a processor 702 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system.

The computer-readable medium can comprise any one of many physical media such as, for example, magnetic, optical, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

Further, any logic or application described herein, including the placement bidding application, may be implemented and structured in a variety of ways. For example, one or more applications described may be implemented as modules or components of a single application. Further, one or more applications described herein may be executed in shared or separate computing devices or a combination thereof. For example, a plurality of the applications described herein may execute in the same computing device 701, or in multiple computing devices in the same computing environment 201. Additionally, it is understood that terms such as "application," "service," "system," "engine," "module," and so on may be interchangeable and are not intended to be limiting.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

at least one computing device; and at least one application executable in the at least one computing device, wherein when executed, the at least one application causes the at least one computing device to at least:

obtain a plurality of bids associated with respective items of a list of items, individual bids including a display placement preference for the respective items in a displayable presentation of the list of items, and the display placement preference comprising at least one of an above-the-fold placement, a left side orientation placement, a right side orientation placement, or a center placement;

modify a position of a specific item associated with an accepted bid within the list of items, the position being based at least in part on the display placement preference;

select a subset of items from the list of items for rendering by a client device based at least in part on a size limitation of a user interface element associated with the client device, the specific item associated with the accepted bid being included in the subset of items; and encode network content including the subset of items.

2. The system of claim 1, wherein when executed, the at least one application causes the at least one computing device to at least determine the size limitation of the user interface element.

3. The system of claim 2, wherein the size limitation of the user interface element is determined in response to a resizing of the user interface element.

4. The system of claim 1, wherein when executed, the at least one application causes the at least one computing device to calculate a number of items included in the subset of items based at least in part on the size limitation of the user interface element.

5. The system of claim 4, wherein when executed, the at least one application causes the at least one computing device to calculate the number of items included in the subset of items in response to a resizing of the user interface element.

6. The system of claim 1, wherein the size limitation of the user interface element comprises at least one of a window size limitation, a frame size limitation, or a network page component size limitation.

7. A method, comprising:

generating, via at least one computing device, a list of items;

obtaining, via at least one computing device, a bid associated with at least one item from the list of items, the bid indicating a preferred position of the at least one item within a rendering of network content, the preferred position comprising at least one of an above-the-fold position, a left side orientation position, a right side position placement, or a center position;

modifying, via the at least one computing device, a position of the at least one item based at least in part on the preferred position of the at least one item; and selecting, via the at least one computing device, at least a subset of items from the list of items for rendering by a client device based at least in part on a display size limitation of the client device, the at least a subset of the list of items comprising the at least one item.

8. The method of claim 7, wherein a number of items included in the at least a subset of items from the list of items is based at least in part on the display size limitation, and the at least one item is included in the at least a subset of items from the list of items.

9. The method of claim 7, wherein the position of the at least one item is modified in response to a determination that the at least one item is excluded from the at least a subset of items from the list of items, the at least one item being included in the at least a subset of items from the list of items after the modifying.

10. The method of claim 7, wherein the bid associated with the at least one item is one of a plurality of bids associated with a respective item in the list of items, further comprising:

calculating, via the at least one computing device, a plurality of projected revenues based at least in part on a respective bid of the plurality of bids;

accepting, via the at least one computing device, the respective bid of the plurality of bids according to a projected revenue of the plurality of projected revenues, the projected revenue being associated with the respective bid of the plurality of bids; and selecting, via the at least one computing device, the at least one item as the respective item in the list of items.

11. The method of claim 10, wherein the plurality of projected revenues are further based at least in part on a projected impression rate or a projected click rate for the respective item in the list of items.

12. The method of claim 11, wherein at least one of the projected impression rate or the projected click rate is based at least in part on a relevance of the respective item of the list of items.

13. The method of claim 7, further comprising encoding network content including the subset of items from the list of items, the at least one item of the subset of items from the list of items being positioned in the network content according to the preferred position.

14. The method of claim 7, wherein the bid associated with the at least one item is one of a plurality of bids associated with a respective item in the list of items, and further comprising:

calculating, via the at least one computing device, a plurality of projected revenues for respective bids of the plurality of bids; and ignoring, via the at least one computing device, the respective bids of the plurality of bids based at least in part on individual ones of the plurality of projected revenues being less than a lowest projected revenue associated with the list of items.

15. A system, comprising:

at least one computing device; and at least one application executable in the at least one computing device, wherein when executed, the at least one application causes the at least one computing device to at least:

obtain a bid associated with a particular item of a list of items, the bid indicating a preferred display position of the particular item in a presentation of the list of items, the preferred display position comprising at least one of an above-the-fold position, a left side orientation position, a right side orientation position, or a center position;

determine an actual display position for the particular item within the list of items based at least in part on the preferred display position and a size limitation of a user interface element; and encode network content for rendering on a client device, the network content including the list of items, and the particular item within the list of items being positioned in the network content according to the actual display position.

16. The system of claim 15, wherein determining the actual display position for the particular item within the list of items further comprises modifying, in the at least one computing device, a position of the particular item from a first position within the list of items to a second position within the list of items, the second position being based at least in part on at least one of a degree associated with the bid or a predefined position associated with the bid.

17. The system of claim 15, wherein the particular item comprises at least one search result, and the list of items is generated in response to a search query.

18. The system of claim 15, wherein when executed, the at least one application further causes the at least one computing device to at least:

obtain another bid for another item to be included in the list of items;

determine to include the other bid in the list of items; and modify the list of items to include the other item.

19. The system of claim 15, wherein, when executed, the at least one application further causes the at least one computing device to at least:

calculate a plurality of relevance scores for respective items of the list of items; and generate the list of items, the list of items including at least one respective item based at least in part on the at least one respective item having a relevance score meeting or exceeding a threshold.

20. The system of claim 19, wherein the plurality of relevance scores are calculated based at least in part on at least one of:

a viewing frequency for the respective items;

a similarity of at least one attribute associated with the respective items to at least one attribute associated with another item; or a purchase history for the respective items.

* * * * *